US005083809A

United States Patent [19]

Stampacchia et al.

[11] Patent Number: 5,083,809

[45] Date of Patent: Jan. 28, 1992

[54] SKI STRUCTURE

[75] Inventors: Marcello Stampacchia, Treviso; Caterina Sabbadin, Padova; Gianfranco Benetti, Postioma; Erminio Bonsembiante, Montebelluna, all of Italy

[73] Assignee: Marcello Stampacchia, Treviso, Italy

[21] Appl. No.: 646,540

[22] Filed: Jan. 28, 1991

[30] Foreign Application Priority Data

Feb. 2, 1990 [IT] Italy ..... 82517 A/90

[51] Int. Cl.[5] ..... A63C 5/02; A63C 5/16

[52] U.S. Cl. ..... 280/603; 280/607; 280/609; 280/14.2; 280/15

[58] Field of Search ..... 280/602, 603, 607, 818, 280/14.1, 14.2, 16, 28.16, 15, 18, 24, 609, 11.28

[56] References Cited

U.S. PATENT DOCUMENTS

| | | | |
|---|---|---|---|
| 3,336,036 | 8/1967 | Manfreda | 280/607 |
| 3,506,279 | 4/1970 | Lambert | 280/14.1 X |
| 4,138,128 | 2/1979 | Criss | 280/14.2 X |
| 4,161,323 | 7/1979 | Wetteland | 280/16 X |
| 4,537,412 | 8/1985 | Hill | 280/14.1 X |
| 4,725,069 | 2/1988 | Stampacchia et al. | 280/607 |

FOREIGN PATENT DOCUMENTS

| | | | |
|---|---|---|---|
| 276102 | 11/1969 | Australia | 280/16 |
| 0184000 | 6/1986 | European Pat. Off. | 280/607 |
| 0258648 | 3/1988 | European Pat. Off. | 280/607 |
| 0378859 | 7/1990 | European Pat. Off. | 280/603 |
| 822351 | 11/1951 | Fed. Rep. of Germany | 280/16 |
| 2010382 | 9/1971 | Fed. Rep. of Germany | 280/602 |
| 2219214 | 12/1989 | United Kingdom | 280/603 |

*Primary Examiner*—Andres Kashinikow
*Assistant Examiner*—Brian L. Johnson
*Attorney, Agent, or Firm*—Guido Modiano; Albert Josif

[57] ABSTRACT

The ski structure has a front ski and a rear ski, vibration dampers and a mechanism for converting a lateral pressure into a rotary motion, associated with one of the skis. The front and rear skis can be temporarily mutually loosely interconnected by at least one tab and can be rigidly interconnected by a removable mechanical bridge. Thus, the rear ski follows the direction assumed by the front ski, and the ski structure can be disassembled for easy transport.

3 Claims, 1 Drawing Sheet

SKI STRUCTURE

BACKGROUND OF THE INVENTION

The present invention relates to a ski structure.

The same Applicant is also the proprietor of U.S. Pat. No. 4,725,069, granted on Feb. 16, 1988 and assumed to be included herein by reference, which claims a self-steering ski structure with gradual absorption of stresses, the peculiarity whereof consists in that it is constituted by one or more elements for resting on the snow which are possibly arranged in front of one another and have one end directed slightly upwardly.

At least two removable supports are associable with said elements, and both supports are connected to a plate by means of a lever device which has conventional means for dampening vibrations and stresses. For a better understanding of the conventional means for dampening vibration and how they are interconnected with the rest of the structure to provide the dampening function, reference should be made to the above-mentioned U.S. Pat. No. 4,725,069, incorporated herein by reference. In particular, one of said supports comprises a conventional means for converting into a rotary motion a pressure exerted proximate to the lateral edge of said plate. For a better understanding of the conventional means for converting into a rotary motion a pressure exerted proximate to the edge of the plate, as well as its specific structure and a description of how it is interconnected with the rest of the structure, reference should again be made to the above-mentioned U.S. Pat. No. 4,725,069, incorporated herein by reference. However, said self-steering ski also has, among its various advantages, the disadvantage of being bulky and difficult to carry. Secondly, a change in direction imparted to the front snow resting element is not followed immediately and in the same manner by the rear snow resting element, giving the skier a feeling of imperfect grip on the snow.

SUMMARY OF THE INVENTION

The aim of the present invention is therefore to eliminate the disadvantages described above in known types by providing a structure which, despite being composed of a front ski and a rear ski with which means suitable for minimizing vibration/oscillations and for converting a lateral pressure into a rotary motion are associated, can at the same time be carried easily without requiring particular supports and/or ski racks to be applied for example to a car.

Within the scope of the above aim, an important object is to provide a structure in which the rear ski can optimally follow the manoeuvres of the front ski.

This aim, this object and others which will become apparent hereinafter are achieved by a ski structure, composed of a front ski and a rear ski, means suitable for dampening vibration and for converting a lateral pressure into a rotary motion being associated with one of said front and rear skis, characterized in that said front and rear skis can be temporarily mutually loosely interconnected by means of at least one tab and can be rigidly interconnected by means of a removable mechanical bridge.

BRIEF DESCRIPTION OF THE DRAWINGS

Further characteristics and advantages of the invention will become apparent from the detailed description of a particular but not exclusive embodiment, illustrated only by way of non-limitative example in the accompanying drawings, wherein.

DESCRIPTION OF THE PREFERRED EMBODIMENTS

Figures 1, 2, 3, 4, 5, 6:
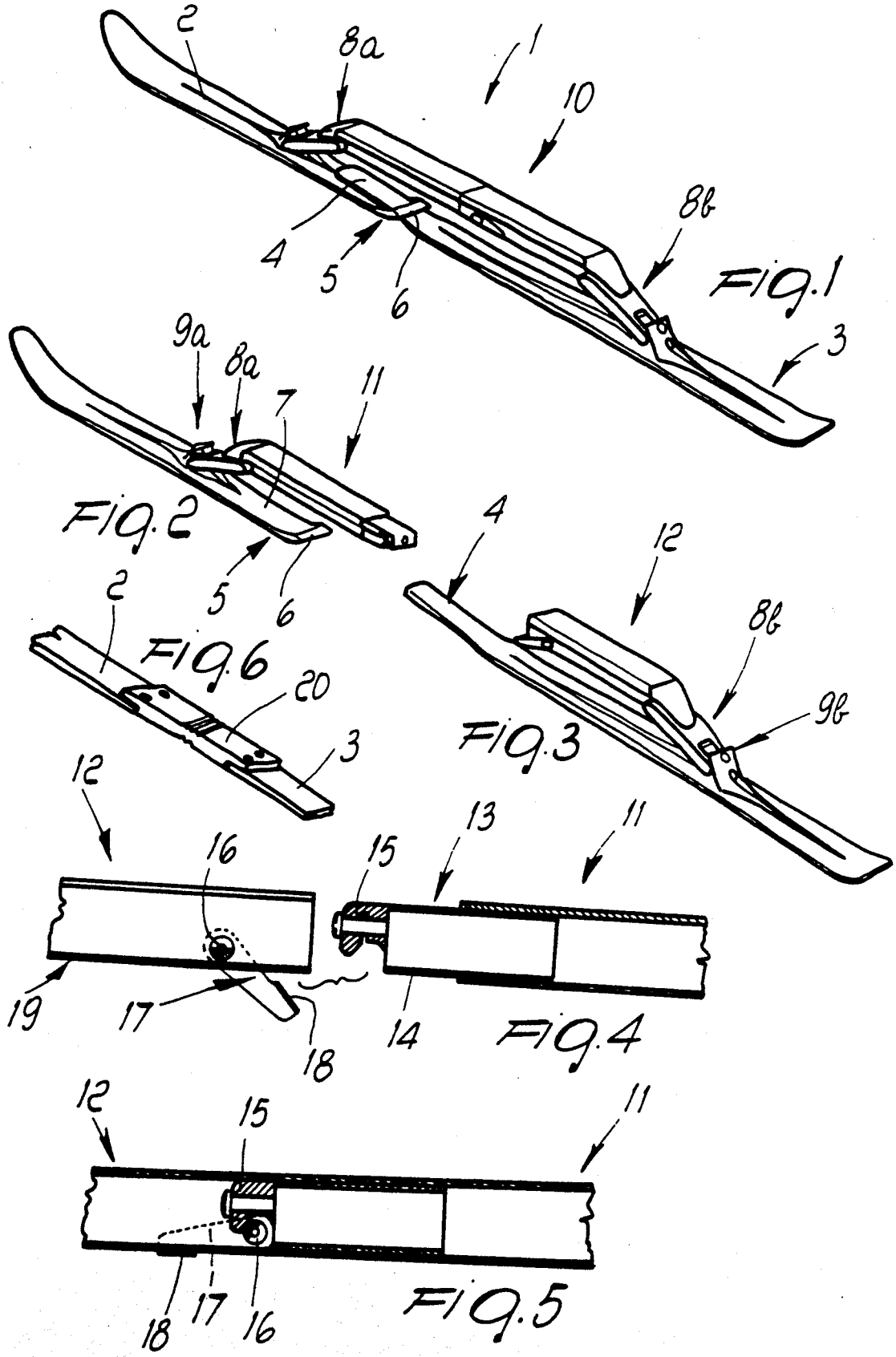
FIG. 1 is a lateral perspective view of the ski structure.
FIG. 2 is a view of the front ski.
FIG. 3 is a view of the rear ski.
FIG. 4 is a view, taken along a longitudinal median plane, of the removable mechanical bridge in the condition in which the components are disengaged.
FIG. 5 is a view, similar to the preceding one, of the condition in which the components are mutually engaged.
FIG. 6 is fragmentary perspective view of the ski structure showing, in another embodiment thereof, a strip located between the facing ends of the front and rear ski.

With reference to the above figures, the ski structure, generally indicated by the reference numeral 1, is composed of a front ski 2 and a rear ski 3, both made of plastic material, composite materials, wood or other suitable materials.

The front ski 2 and the rear ski 3 expediently have different lengths and can be temporarily mutually loosely interconnected by means of at least one tab 4 which protrudes in front of the rear ski 3.

Said tab 4 advantageously has a slightly smaller thickness than said rear ski 3; said tab furthermore has a slightly inclined configuration and is suitable for being arranged at a plane which is parallel to, and higher than, that of the rear end 5 of the front ski 2.

Advantageously, a spoiler 6 is defined at said rear end 5 and protrudes from the upper surface 7 of said rear end 5.

The tab 4 of the rear ski 3 can thus be arranged between said spoiler 6 and the upper surface 7.

Both the front ski 2 and the rear ski 3 have means suitable for dampening vibration, thereby reducing oscillations imparted to the ski, said means being indicated by the numerals **8*a* and 8*b***.

Means suitable for converting a lateral pressure into a rotary motion, for allowing a skier to turn, are furthermore present at the front ski 2 and at the rear ski 3 and are indicated by the numerals **9*a* and 9*b*. The front ski 2 and the rear ski 3 can furthermore be mutually rigidly interconnected by means of a mechanical bridge 10 which is rigidly associated, at its ends, with the means 8*a* and 8*b***.

Said mechanical bridge 10 is constituted by a first half-bridge 11 and by a second half-bridge 12 which have means for their mutual temporary engagement.

Said first and second half-bridges advantageously have a box-like configuration and are made of metal or of another material with high strength and modest weight.

An engagement element 13, constituted by a bar 14 from the end of which a hook 15 projects, protrudes at the free end of the first half-bridge 11.

Said hook 15 removably engages at an eccentric pivot 16 which is rotatably and freely associated transversely to the second half-bridge 12 proximate to its free end.

The eccentric pivot 16 is connected, at its ends, to a handle 17 which is external to the second half-bridge 12 and the wings whereof are connected to a base 18 which, during the mutual securing of the hook and the eccentric pivot, becomes arranged parallel and adjacent to the lower surface 19 of the second half-bridge 12.

The use of the ski structure is therefore as follows: after separately taking the two components constituted by the front ski 2 connected to the first half-bridge 11 by virtue of the means 8*a* and 9*a* and by the rear ski 3 connected to the second half-bridge 12 by virtue of the means 8*b* and 9*b*, in order to obtain the final structure illustrated in FIG. 1 it is initially sufficient to insert the tab 4 of the rear ski 3 at the interspace defined between the spoiler 6 and the upper surface 7 of the rear end 5 of the front ski 2.

In this manner, the terminal ends of the first half-bridge and of the second half-bridge are moved mutually closer, until the hook 15 is inserted in the second half-bridge 12.

In this manner, the hook 15 is located at the eccentric pivot 16; the securing between said hook and said pivot occurs by virtue of a rotation which the skier can impart to the handle 17.

Once said handle has been rotated, one obtains a ski structure which is safe and reliable in use and which naturally has, at the first half-bridge 11 and at the second half-bridge 12, bindings for boots or other particular items of footwear.

As an alternative to the tab 4, it is possible to provide a strip 20, such as an elastic strip, between the facing ends of the rear ski 3 and of the front ski 2.

Optimum skiing is thus possible, since the rear ski follows the manoeuvres of the front ski.

It has thus been observed that the invention has achieved the intended aim and objects, a ski structure having been obtained which can be separated into two components which can be easily placed in a suitable bag or directly for example in the trunk of a car without requiring their placement on a luggage-rack or ski-rack.

The presence of the tab and the spoiler or of the strip for temporary interconnection between the facing ends of the front ski and of the rear ski furthermore allows the skier to achieve greater sensitivity while skiing.

The invention is naturally susceptible to numerous modifications and variations, all of which are within the scope of the same inventive concept.

The materials, as well as the components which constitute the individual elements of the structure, may naturally also be the most pertinent according to the specific requirements.

We claim:

1. Ski structure comprising;

a front ski having a rear end, an upper surface provided on said rear end of said front ski, a rear ski, means for dampening vibration connected to one of said front ski and said rear ski, means for converting a lateral pressure into a rotary motion being associated with one of said front ski and said rear ski, at least one tab, said tab temporarily mutually loosely interconnecting said front ski and said rear ski, and a removable mechanical bridge rigidly connecting said front ski and said rear ski, wherein said front ski and said rear ski have different lengths, wherein said tab protrudes in front of said rear ski, said tab having a slightly smaller thickness than said rear ski, said tab furthermore having a slightly inclined configuration and lying on a plane, said plane being parallel to, and higher than said rear end of said front ski, wherein said ski structure further comprises a spoiler defined at said rear end and protruding from said upper surface of said rear end, and wherein said tab of said rear ski is positioned between said spoiler and said upper surface.

2. Ski structure according to claim 1, wherein said mechanical bridge has bridge ends, said bridge ends being connected to said means for dampening vibration, said mechanical bridge being constituted by a first half-bridge and a second half-bridge, said ski structure further comprising means for mutually temporarily engaging said first half-bridge and said second half-bridge, wherein said first half-bridge has a first half-bridge free end, and wherein said second half-bridge has a second half-bridge free end, an engagement element protruding at said first half-bridge free end, said engagement element being constituted by a bar, said bar having an end, a hook protruding from said end of said bar, said hook removably engaging an eccentric pivot, said eccentric pivot being rotatably connected transversely to said second half-bridge proximate to said second half-bridge free end.

3. Ski structure according to claim 1, wherein said mechanical bridge has bridge ends, said bridge ends being connected to said means for dampening vibration, said mechanical bridge being constituted by a first half-bridge and a second half-bridge, said ski structure further comprising means for mutually temporarily engaging said first half-bridge and said second half-bridge, wherein said first half-bridge has a first half-bridge free end, and wherein said second half-bridge has a second half-bridge free end and a lower surface, an engagement element protruding at said first half-bridge free end, said engagement element being constituted by a bar, said bar having an end, a hook protruding from said end of said bar, said hook removably engaging an eccentric pivot, said eccentric pivot being rotatably connected transversely to said second half-bridge proximate to said second half-bridge free end, and wherein said eccentric pivot has eccentric pivot ends, said eccentric pivot ends being connected to a handle, said handle being located external to said second half-bridge, said handle having wings, said wings being connected to a base, said base being arranged parallel and adjacent to said lower surface of said second half-bridge during mutual securing of said hook and said eccentric pivot.

* * * * *